United States Patent [19]

Simmons

[11] 3,974,625

[45] Aug. 17, 1976

[54] LOADING ARTICLES INTO BAGS

[75] Inventor: John Ernest Simmons, Ruislip, England

[73] Assignee: EMI Limited, Hayes, England

[22] Filed: July 18, 1973

[21] Appl. No.: 380,206

[30] Foreign Application Priority Data

July 29, 1972 United Kingdom ..... 35549/72

[52] U.S. Cl. ..... 53/189; 53/386

[51] Int. Cl.[2] ..... B65B 43/28

[58] Field of Search ..... 53/189, 190, 386

[56] References Cited

UNITED STATES PATENTS

| | | | |
|---|---|---|---|
| 2,008,896 | 7/1935 | Brown | 53/189 |
| 2,350,666 | 6/1944 | Allen | 53/386 X |
| 2,528,997 | 11/1950 | Blanchard | 53/189 |
| 2,633,281 | 3/1953 | Rasmusson | 53/189 |

*Primary Examiner*—Travis S. McGehee

*Attorney, Agent, or Firm*—Fleit & Jacobson

[57] ABSTRACT

A bagging machine is combined with a gramophone record moulding machine. In the bagging machine, pivotable suction means removes the front bag from a stack of bags having their open ends uppermost. The rear edge of the mouth of the bag is held by a stationary member so that the mouth is opened when the suction head grips the front surface of the first bag in the stack and pivots away from the stack. A record is delivered down a chute into the opened bag which is then released by the suction head to fall to collection means such as a box. The stack of bags are supported on a carrier, and in order to prevent the second bag (and possibly further bags) from lifting due to friction between bags as the first bag is removed, means are provided in proximity to the upper edges of at least the first few bags in the stack. In the specific embodiment described, these means comprise a pair of ears bent out of the plane of the member which holds the rear edge of the bag mouth. A record is transferred from the moulding machine to a trimmer, and, after trimming, is released to fall onto the chute and thence into an opened bag.

7 Claims, 3 Drawing Figures

LOADING ARTICLES INTO BAGS

This invention relates to machines for loading articles into bags.

In our U.S. Pat. No. 3,481,111 there is described a machine for loading articles into bags including means for opening the mouth of a bag from a stack of bags, the mouth of said bag being uppermost, means for transporting one of said articles from a stack of said articles to a release position and then for releasing said article in the release position effectively above the bag which has been opened by said first means, and control means for operating said first and second means in timed relationship so that for each operation of said first means an article is positioned by said second means and released in time to drop into the respective opened bag.

In a machine according to said aforementioned Patent Specification, the articles are first formed into a stack from which they are then removed one at a time and loaded into bags.

It is sometimes preferable to load the articles directly into bags as they leave the article-forming apparatus, thus reducing the number of handling operations required with the concomitant reduction of the possibility of damaging the articles. An additional advantage of bagging the article immediately it is formed is that there is less opportunity for it to collect dust or grit which may damage the article. This is particularly important where the article contains fine detail of structure, such as the sound track of a gramophone record.

It is an object of the present invention to provide an improved machine for loading articles into bags.

According to the invention there is provided a machine for loading gramophone records into bags having open tops comprising:

- a base for supporting a stack of bags with their bottoms in contact with the base,
- a first projection projecting over the front of the stack at the bottom of the bags to prevent the first bag in the stack from moving off the base,
- a second projection for projecting into the mouth of the first bag in the stack so as to retain the back of the bag,
- bag moving means pivotted for arcuate movement pulling and lifting the front of the first bag away from the back to open to bag and thereby moving the bottom of the bag past the first projection,
- means for delivering a gramophone record to the opened bag at the front of the stack in such a way that the record carries the bag away from the second projection on release from said pivotted means,
- means located rearwardly of the second projection over and in proximity to at least the second bag in the stack to tend to prevent the second bag being lifted when the bottom of the first bag is moved past the first projection.

Figure 1:
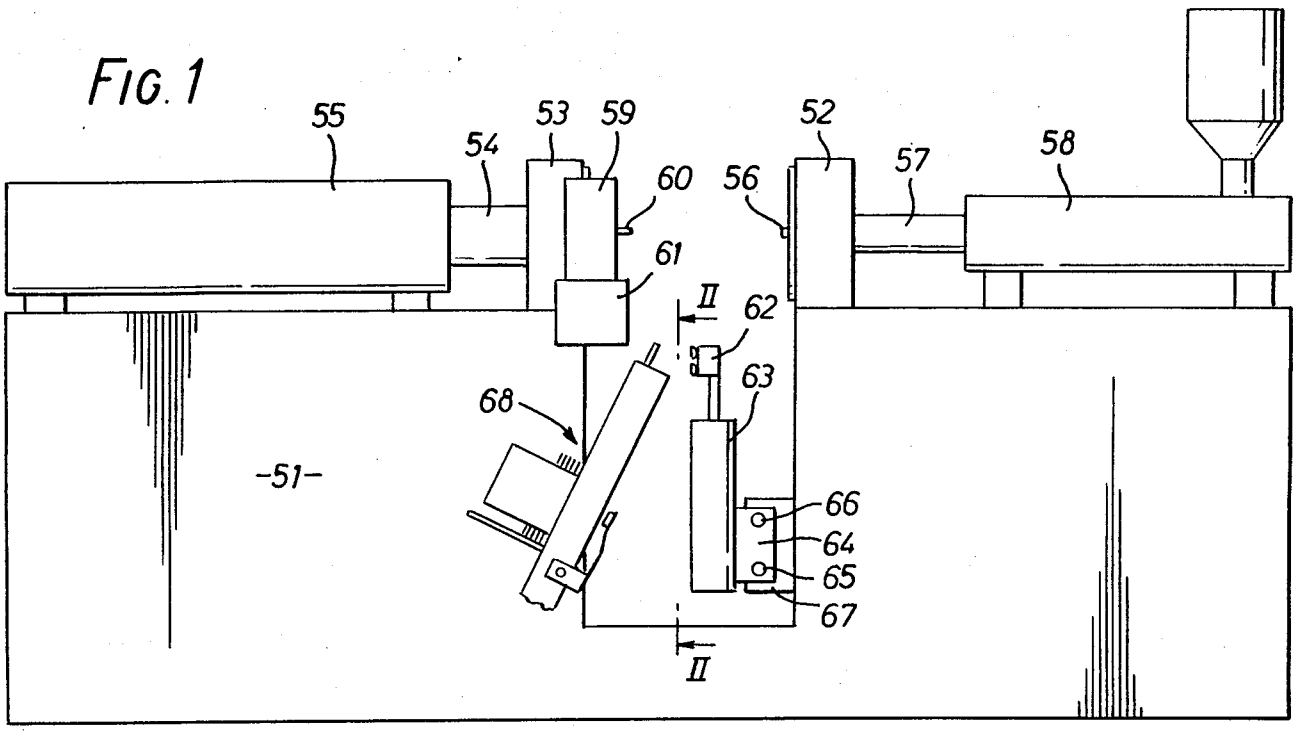
Figure 2:
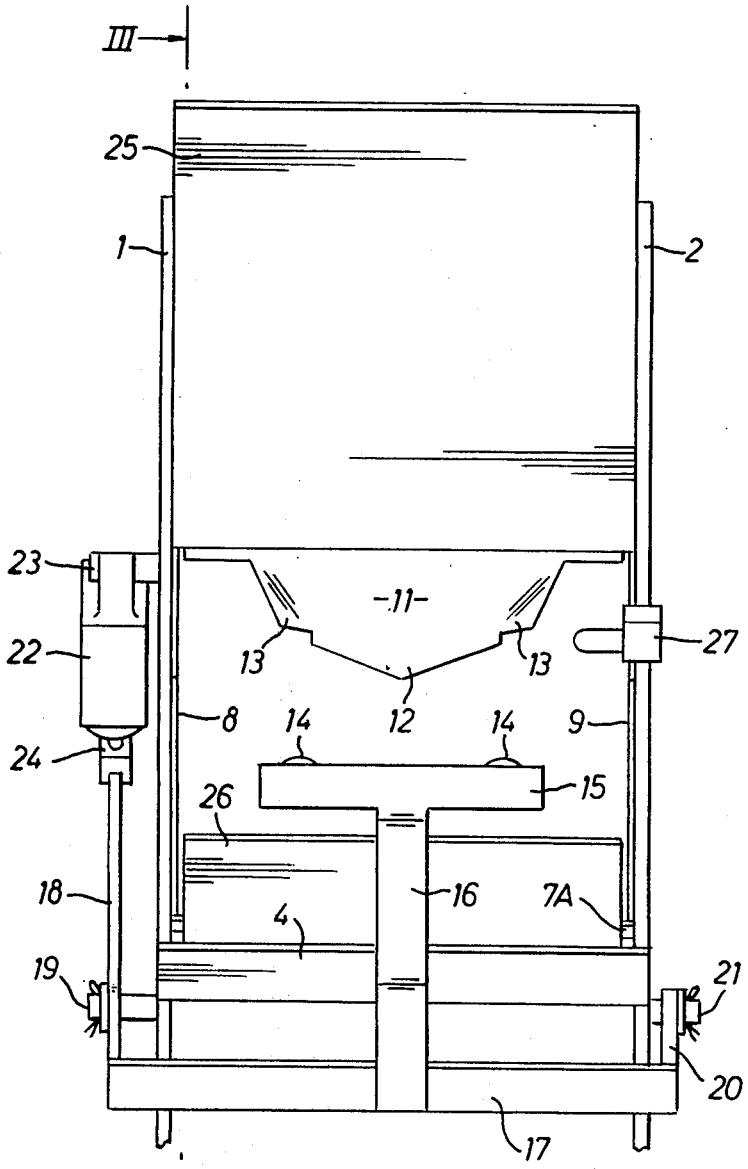
Figure 3:
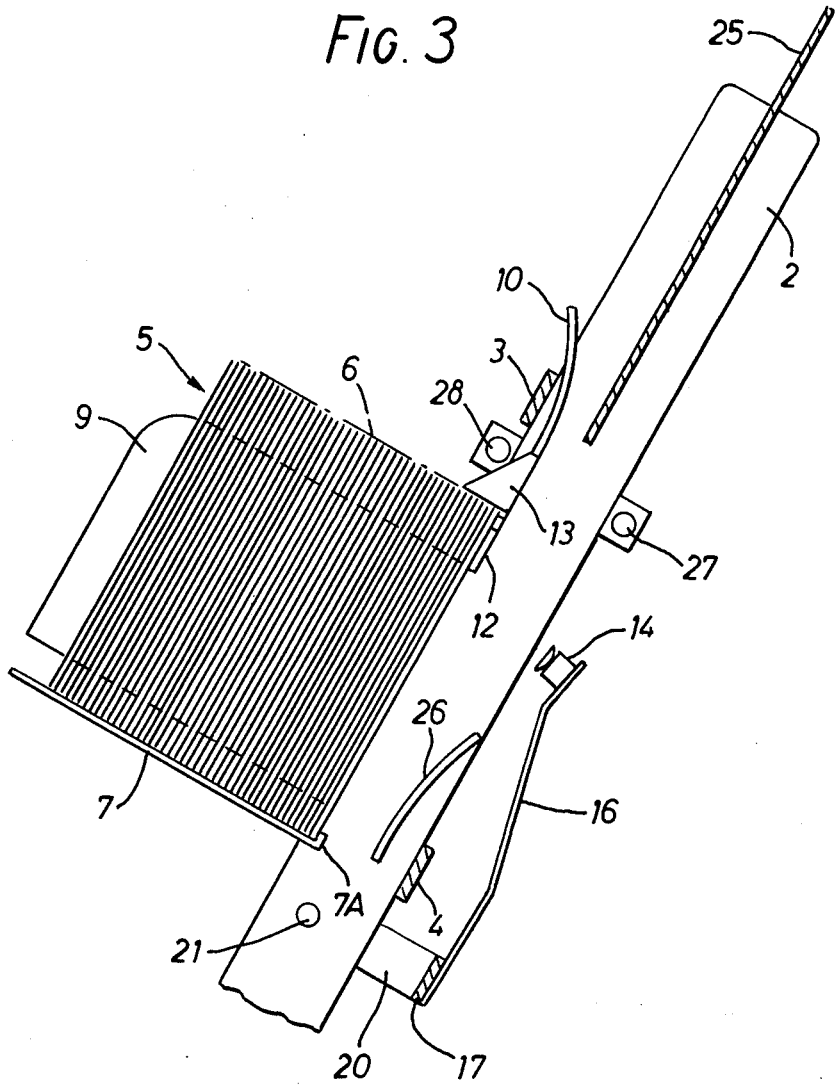

In order that the invention may be clearly understood and readily carried into effect it will now be described by way of example with reference to the accompanying drawings in which:

FIG. 1 illustrates diagrammatically a side view of a gramophone record press in association with a bagging machine in accordance with the invention, FIG. 2 illustrates diagrammatically a view of the bagging machine in the direction II—II of FIG. 1, and FIG. 3 illustrates diagrammatically a view in the direction III—III of FIG. 2.

For illustrative purposes only, the invention is described as applied to the bagging of gramophone records. It will be understood, however, that the invention is applicable to the loading of other articles, especially generally flat articles such as saucers or plates.

Referring firstly to FIG. 1, there is shown a bagging machine combined with an injection moulding machine for gramophone records. The moulding machine is mounted on a bed 51 and has a fixed mould part 52 and a movable mould part 53 which is reciprocated towards and away from the fixed mould part 52 on guides or tie bars (not shown) by the ram 54 of a pneumatic or hydraulic cylinder 55. Mouldable material is supplied to the mould cavity through the nozzle tip 56 of an injection barrel 57 fed by a screw feeder 58. A hopper maintains a supply of mouldable material to the screw feeder 58. The mould parts 52 and 53 will be provided with stampers, in known manner, for producing the sound tracks on the record.

When the mould parts separate, the record is retained, in known manner, on the movable mould part 53. The record is transferred to the side of the mould to a trimming support 59 having a retractable pin 60 upon which the record rotates while peripheral flash is removed by a trimmer 61. The record is transferred from the mould block 53 to the trimming support 59 by means of a suction head 62 mounted on the operating arm of an air cylinder 63. The air cylinder 63 is secured to a carrier block or plate 64 so as to be reciprocable along rods 65 and 66 which are secured to the bed 51 by mounting means 67. The air cylinder 63 reciprocates under the influence of another air cylinder (not shown) between the position at which the suction head 62 can take a record from mould part 53 to a position at which the suction head 62 can place the record onto the trimming support 59 and its pin 60, the suction head 62 being raised to the correct level by the air cylinder 63. The suction head 62 is itself reciprocable, from right to left as seen in FIG. 1, by means (not shown) so as to move into engagement with a record on the mould part 53 and so as to place the record on the trimming support 59. This manoeuvring of the suction head 62 is necessitated by the fact that the guides (not shown) along which the movable mould part 53 reciprocates extend to the fixed mould part 52. If, required, the record supported on the trimming support 59 may undergo further treatment, such as punching. When the record has been trimmed, the pin 60 is retracted and the record falls to a bagging machine indicated by the general reference 68. If the record does not require trimming or other treatment, the suction head 62 can be arranged to release the record so that it falls to the bagging machine 68.

Referring now to FIGS. 2 and 3 of the drawings, the bagging machine has a frame comprising side members 1 and 2 and cross members 3 and 4. This frame is fixed relative to the record-producing apparatus in any suitable manner. For example, it may be secured directly to the bed 51 or it may be fixed to the floor. As seen in side elevation in FIGS. 1 and 3, the frame side members 1 and 2 are mounted at an angle to the vertical, for example at an angle of 30°. A stack of bags 5 with their open ends uppermost along edges 6, is loaded in a carrier secured to the frame. The stack carrier comprises a base plate 7 and side walls 8 and 9. Due to the inclination of base 7, the bags slide therealong under the influence of gravity without the need for further assistance, although such assistance may be provided if desired.

A plate 10 is secured to the frame and at its lower end has a depending part 11, the end 12 of which engages the upper open end of the front bag in the stack 5. The bag-engaging end 12 of part 11 serves two functions. The first is to prevent the bags from falling off the carrier, and to this end there is provided other bag-engaging means, for example, the small upturned lip 7A on the front end of the base plate 7 of the bag carrier, which engages the lower edge of the front bag of the stack. Alternatively, short fingers or screws may be provided in the side members 1 and 2 which engage the side edges of the front bag of the stack. The second function of the end 12 of the part 11 is to assist in opening the front bag of the stack as will hereinafter be more fully described. A pair of ears 13 are formed on the depending part 11 of the plate 10 by bending the corners towards the stack of bags. The ears 13 extend closely above the first few bags in the stack 5 for a purpose hereinafter described. The bottom edge of the ears may be formed at such an angle as to provide a space between the bottom edges of the ears and the top edges 6 of the bags, which space widens with increasing distance from the plate 10.

A pair of suction heads 14 are carried by the cross piece 15 of a T-shaped arm whose stem 16 is attached at its lower end to a cross piece 17 which forms part of pivoting means. The cross piece 17 is attached at one end to a cranked arm 18 pivotable about a pivot 19 on side member 1, and at its other end to an arm 20 pivotable about a pivot 21 on side member 2 which is coaxial with the pivot 19. An air cylinder 22 is pivotable about a pivot 23 on side member 1 and has its operating arm 24 pivotally connected to the other end of the cranked arm 18, whereby to cause the suction heads 14 to swing about the axis of the pivots 19 and 21.

A chute 25 catches the records as they are released from the trimming support 59 and delivers them for bagging, and a plate 26 guides the bagged record to, for example, a collection station such as a box (not shown). A photo-cell unit 27 and light unit 28 are mounted on side member 2 to monitor the delivery of a record to an opened bag.

A cycle of operation of the bagging machine will now be described, the appropriate timed sequence being provided by any suitable timing control means known per se and therefore not herein described. A finished gramophone record is delivered to the chute 25 from the record trimming station which removes the flash from the periphery of the record and/or punches a centre hole in the record. Prior to the delivery of the record to the chute 25, an opened bag is positioned to receive it. This is effected by operating the ar motor 22 to extend its operating arm 24 which causes the cranked arm 18 to rotate about pivot 19. The suction heads 14 also swing about pivot 19 and engage the front wall of the first bag in the stack 5. As previously mentioned, the bags are placed in the stack with their open ends uppermost along their edges 6. The upper edges of the front walls (i.e. the walls facing the suction heads 14) have a cutaway portion such that the front wall can pass below the bag-engaging end 12 of the plate 10. Vacuum is applied to the suction heads 14 which thus grip the front wall of the first bag in the stack. The air motor 22 is then operated to retract its operating arm 24, the suction heads 14 pulling the front wall of the first bag with them as they swing about pivot 19. The bag is pulled past the bag retaining means previously described, such as the shallow upward extending flange 7A on the base plate 7 of the stack carrier. The upper edge of the rear wall of the bag is held by the bag-engaging end 12 of the plate 10, which is stationary, and therefore the mouth of the bag is opened. The record slides down the chute 25 into the opened bag. The vacuum to the suction heads 14 is released and the bagged record slides down the guide 26 to the collection means. The photo-cell 27 and the lamp 28 monitor the arrival of a record, and preferably there is also provided monitoring means for monitoring the presence of an opened bag before the record is delivered to the bagging machine.

Upon removal of the front bag from the stack 5 of bags by the suction heads 14, there is a tendency for at least the second bag also to be lifted over the shallow flange 7A on the front edge of plate 7, which may be in the region of 0.03 to 0.06 inches high, due to friction between the bags and if no steps were taken to counteract this, the second bag would also be detached from the stack and fall to the collection means. Or again, the friction between the bags may cause them to be lifted so as to jam behind the plate 10 so that it becomes impossible for the suction heads to detach and open a bag without tearing it. This is highly undesirable since it may lead to the stopping of the bagging machine, which in turn would lead to the stopping of the moulding machine. Means are provided which extend over and in proximity to the upper edges of the first few bags in the stack, and so prevent lifting of the second bag as the first bag is removed. In the present example, the means comprise the ears 13, but it will be appreciated that means other than the ears 13 may be provided for preventing lifting of the bags when the first bag is removed.

Although the invention has been described with reference to a bagging machine in conjunction with the article-producing machine, it will be appreciated that other means may be employed for supplying the articles to the chute 25. For example, the articles may be transferred to the chute from a stack of the articles.

What I claim is:

1. A machine for loading gramophone records into bags having open tops comprising;

a base for supporting a stack of bags with their bottoms in contact with the base, a first projection projecting over the front of the stack at the bottom of the bags to prevent the first bag in the stack from moving off the base, a second projection for projecting into the mouth of the first bag in the stack so as to retain the back of the bag, bag moving means pivotted for arcuate movement pulling and lifting the front of the first bag away from the back to open the bag and thereby moving the bottom of the bag past the first projection, means for delivering a gramophone record to the opened bag at the front of the stack in such a way that the record carries the bag away from the second projection on release from said pivotted means, means located rearwardly of the second projection over and in proximity to at least the second bag in the stack to tend to prevent the second bag being lifted when the bottom of the first bag is moved past the first projection.

2. A machine according to claim 1 in which said means for moving a bag comprises suction means.

3. A machine according to claim 1 in which said first projection is an upstanding flange at the lower front end of said carrier.

4. A machine according to claim 1 in which said means for preventing lifting of said second bag are attached to said second projection.

5. A machine according to claim 4 in which said second projection comprises a plate-like member and said means is a pair of ears bent out of the plane of said plate-like member to extend over and in proximity to bags in the stack.

6. In combination a machine according to claim 1 and a machine for moulding a gramophone record and including means for releasing the record to the loading machine.

7. A combination according to claim 6 including an intermediate station for carrying out an operation on the record which is one of punching, trimming and punching and trimming, and means for transferring the record from the record moulding machine to the intermediate station for subsequent said release.

* * * * *